US005933346A

United States Patent [19]

Brabec et al.

[11] Patent Number: 5,933,346

[45] **Date of Patent: *Aug. 3, 1999**

[54] BUCKET DEPTH AND ANGLE CONTROLLER FOR EXCAVATOR

[75] Inventors: Vernon J. Brabec; Bill B. Crumb, both of Livermore; Renard T. Graham, Antioch, all of Calif.

[73] Assignee: Topcon Laser Systems, Inc., Pleasanton, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/658,701

[22] Filed: Jun. 5, 1996

[51] Int. Cl.[6] ..... G06F 19/00

[52] U.S. Cl. ..... 364/167.07; 37/414; 364/167.07; 364/160; 364/180; 340/684; 340/685; 340/686; 414/694; 414/698; 414/699; 414/700

[58] Field of Search ..... 364/167.01, 424.07, 364/424.05, 425.09, 160, 180, 424.01; 172/2, 4, 3, 4.5, 7, 8, 12; 414/694, 698, 699, 700; 340/684–686

[56] References Cited

U.S. PATENT DOCUMENTS

| | | | |
|---|---|---|---|
| 3,586,184 | 6/1971 | Pesavento | 214/136 |
| 3,997,071 | 12/1976 | Teach | 214/761 |
| 4,034,490 | 7/1977 | Teach | 37/86 |
| 4,044,610 | 8/1977 | Oldaeus et al. | 73/133 R |
| 4,050,171 | 9/1977 | Teach | 37/86 |
| 4,119,212 | 10/1978 | Flemming | 214/1 CM |
| 4,129,224 | 12/1978 | Teach | 214/763 |
| 4,393,606 | 7/1983 | Warnecke | 37/103 |
| 4,491,927 | 1/1985 | Bachmann et al. | 364/561 |
| 4,726,682 | 2/1988 | Harms et al. | 356/375 |
| 4,733,355 | 3/1988 | Davidson et al. | 364/424 |
| 4,826,391 | 5/1989 | Lawrence et al. | 414/698 |
| 4,829,418 | 5/1989 | Nielsen et al. | 364/167.01 |
| 4,863,337 | 9/1989 | Ishiguro et al. | 414/699 |
| 4,884,939 | 12/1989 | Nielsen | 414/698 |
| 4,888,890 | 12/1989 | Studebaker et al. | 37/103 |
| 5,065,326 | 11/1991 | Sahm | 364/424.07 |
| 5,088,020 | 2/1992 | Nishida et al. | 364/160 |
| 5,308,219 | 5/1994 | Lee et al. | 414/695 |
| 5,347,448 | 9/1994 | Nam | 364/167.01 |
| 5,356,259 | 10/1994 | Hanamoto et al. | 414/694 |
| 5,359,517 | 10/1994 | Moriya et al. | 364/167.01 |
| 5,361,211 | 11/1994 | Lee et al. | 364/167.01 |
| 5,535,532 | 7/1996 | Fujii et al. | 364/424.07 |

FOREIGN PATENT DOCUMENTS

| | | |
|---|---|---|
| 48-124026 | 11/1973 | Japan . |
| 49-121332 | 10/1974 | Japan . |
| 49-121944 | 10/1974 | Japan . |

*Primary Examiner*—William Grant
*Assistant Examiner*—Peter W. Eissmann
*Attorney, Agent, or Firm*—Limbach & Limbach, LLP

[57] ABSTRACT

A method is disclosed for controlling the cutting depth and angle of an excavator bucket to excavate a surface to a desired contour. The method includes the steps of: (1) inputting data to a machine control system to define a desired contour of the excavated surface; (2) positioning the excavator bucket close to the desired contour; (3) enabling automatic control; and (4) automatically controlling movement of the excavator bucket only when the position of the excavator bucket is within a predetermined distance or angle of the desired contour. The method is used to automatically control the excavation to a desired depth if the bucket is within a predetermined distance of a desired depth. The method is also used to automatically control the angular orientation of bucket if the slope of the bucket is within a predetermined angle of a desired slope.

14 Claims, 7 Drawing Sheets

BUCKET DEPTH AND ANGLE CONTROLLER FOR EXCAVATOR

BACKGROUND OF THE INVENTION

This invention relates generally to machine control systems for excavators, and relates more particularly to a method for automatically controlling the depth and angular orientation of an excavator bucket.

Description of the Relevant Art

Excavators are digging machines, typically mounted on tracks. An excavator has a bucket mounted to the end of a two member linkage. One of the links, called a boom, is pivotally mounted to a machine base of the excavator and extends outward in an upward direction. The other link, called a stick, is pivotally mounted at one end to the outer end of the boom and extends downward from the boom pivot. The bucket is pivotally mounted to the outer end of the stick. Three hydraulic cylinders independently move the boom, the stick, and the bucket under the control of an operator or a machine control system. Another hydraulic drive rotates the machine base relative to the track to permit repositioning the bucket for operations like dumping.

Operating an excavator efficiently requires a skilled operator. Each of the couplings between the machine base, boom, stick, and bucket are pivots, so extending or retracting any single hydraulic cylinder or actuator causes the digging edge of the bucket to move in an arc. Most excavating projects, however, involve creating finished surfaces that are planar, either horizontal or sloped. Thus multiple cylinders need to be controlled simultaneously in order to excavate planar surfaces with the bucket. Typically, two joysticks are used by the operator, with each joystick being moveable left and right to control extension and retraction of one cylinder and moveable forward and aft to control extension and retraction of another cylinder.

One problem encountered with an excavator is how to indicate to the operator the depth to which the cutting edge of the bucket is digging so that the correct elevation or grade is obtained by the excavation process. A related problem is that the cutting edge of the bucket can be out of sight of the operator. One known way to indicate depth is to utilize angular sensors that measure the relative angles between the machine base, boom, stick, and bucket, and to calculate the depth of the bucket, using principles of geometry, given the measured angles and the lengths of the links. The calculated depth is then displayed for the operator, as disclosed, for example, in U.S. Pat. No. 4,129,224.

An extension to this concept is to utilize the measured depth and/or slope information to automatically control the movement of the excavator bucket. In U.S. Pat. No. 4,129,224, for example, the hydraulic cylinder that moves the stick is controlled by the operator, and the machine control system automatically controls the boom cylinder and the bucket cylinder to result in a linear movement of the bucket.

A significant shortcoming of such prior automatic machine control systems is that they remove the operator from the control loop when the automatic control is engaged. If the automatic machine control system is automatically controlling the digging depth, but there is a large amount of material to remove before reaching the desired grade, then the machine control system can take too large a cut, which can overload the excavator, resulting in inaccurate cuts and equipment breakage.

SUMMARY OF THE INVENTION

In accordance with the illustrated preferred embodiment, the present invention provides a method for controlling the cutting depth and angle of an excavator bucket to excavate a surface to a desired contour such as depth or slope. The method of the present invention works in conjunction with a machine control system that determines the position of the excavator bucket and automatically controls the position and movement of the bucket during excavation.

The method of the present invention includes the steps of: (1) inputting data to the machine control system to define a desired contour (depth or slope) of the excavated surface; (2) positioning the excavator bucket close to the desired contour; (3) enabling automatic control; and (4) automatically controlling movement of the excavator bucket only when the position of the excavator bucket is within a predetermined distance or angle of the desired contour.

The machine control system is capable of operating in at least two modes: a depth-control mode involving excavating to a desired depth, and a slope-control mode involving excavating to a desired slope. An optional laser-control mode involves excavating to a desired depth and/or slope using a laser elevation reference. The present invention works with these operational modes of the machine control system to control the depth or angular orientation of the bucket.

When the machine control system is operating in the depth-control mode, the present invention engages automatic depth control only if the cutting edge of the excavator bucket is within a small distance above or below the desired depth. The automatic depth control of the present invention will engage during an excavation if (1) it is enabled by the operator and (2) the cutting edge is within the predetermined small distance, or "working depth window," of the desired depth. If the excavator bucket is positioned outside the working depth window with respect to the desired depth, then the automatic depth control of the present invention does not engage. This aspect of the present invention—automatic control of the cutting depth—works with the depth-control mode of the machine control system, but not the slope-control mode of the machine control system because the slope-control mode controls the slope, not the depth, of the cut.

Another aspect of the present invention is to automatically maintain the angular orientation of the bucket during an excavation, but only if the slope of the bottom of the bucket is within a predetermined small angle of a desired slope. The desired slope is either an inclined angle set in the slope-control mode of the machine control system, or is horizontal in the depth-control mode of the machine control system. The automatic bucket angle control of the present invention will engage during an excavation if (1) it is enabled by the operator and (2) the slope of the bottom surface of the bucket is within a small angle, or "working angular window," of the desired slope. If the angle of the excavator bucket is outside the working angular window with respect to the desired slope, then the automatic bucket angle control does not engage. This aspect of the invention works with both the depth-control and slope-control modes of the machine control system. In slope control, the working angular window is an angular range above and below the desired slope. In depth control, the desired slope is zero, so the working angular window is an angular range above and below horizontal.

Both the depth of the cut and the angle of the bucket can be automatically controlled by the present invention when operating in depth-control mode of the machine control system. This occurs when (1) the operator enables the automatic control; (2) the cutting edge of the bucket is within the working depth window of the desired depth; and (3) the angular orientation of the bucket is within the working angular window of horizontal. If those three conditions are met, then the bucket movement is automatically controlled so that the cutting edge cuts along the desired depth and the bucket orientation remains constant during the excavation pass.

In the preferred embodiment, the working depth window for bucket depth control is six inches (0.5 feet or 0.15 meters) above and below the desired grade of the excavated surface. Thus, automatic control of the digging depth can be engaged if the cutting edge of the excavator bucket is above or below the desired grade by six inches or less. If the bucket is either below grade by more than six inches or above grade by more than six inches, then the automatic depth control will not engage. The present invention makes sure that the final grading pass, under automatic control, takes a small cut of six inches or less, which will not overload the excavator.

Also in the preferred embodiment, the working angular window for bucket angle control is plus or minus 10% slope (5.7 degrees) with respect to the desired slope of the excavated surface. If the bottom surface of the excavator bucket is within 10% slope of the desired slope, then the automatic bucket angle control can be engaged by the operator, and the angular orientation of the bucket will be maintained throughout the digging pass. Conversely, if the bottom surface of the bucket is more than 10% slope away from the desired slope of the excavated surface, then the automatic bucket angle control will not engage. The present invention permits the operator to select a bucket angle within the working angular window to suit the digging conditions, and that bucket angle will be held constant by the automatic machine control system during a digging pass.

If the bucket depth or angle is outside the respective working windows when the operator enables automatic control, the automatic control of the cutting depth or bucket angle will not engage until the bucket moves into a working window during the excavation pass.

Another aspect of the present invention is its application to grading multiple layers. This feature is useful when backfilling several layers of materials into a trench. The present invention allows the various depths and layer thicknesses to be defined once for the entire multiple layer excavation task, and engages the automatic depth control whenever the bucket is within the working depth window of one of the desired levels. In this mode of operation, an operator can excavate the trench to a desired depth and then backfill the trench with bedding materials to a selected thickness of the bedding layer. The automatic depth control is engaged when the bucket is within the working depth window of the desired top surface of the bedding layer, which permits automatic grading of the top surface of the bedding layer. Then, typically, pipe or conduit would be laid in the trench on top of the bedding layer, after which the excavator operator can backfill with cover material, also to a selected thickness. Again, the automatic depth control is engaged when the bucket is within the working depth window of the top surface of the cover layer. A top layer of backfill material can then be graded to a desired thickness to complete the excavation task.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

FIGS. 1 through 7 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

The preferred embodiment of the present invention is a method of controlling an excavator by automatically controlling the depth and/or angular orientation of the excavator bucket when its actual position is within a predetermined distance or angle measurement of a desired grade.

Figure 1:
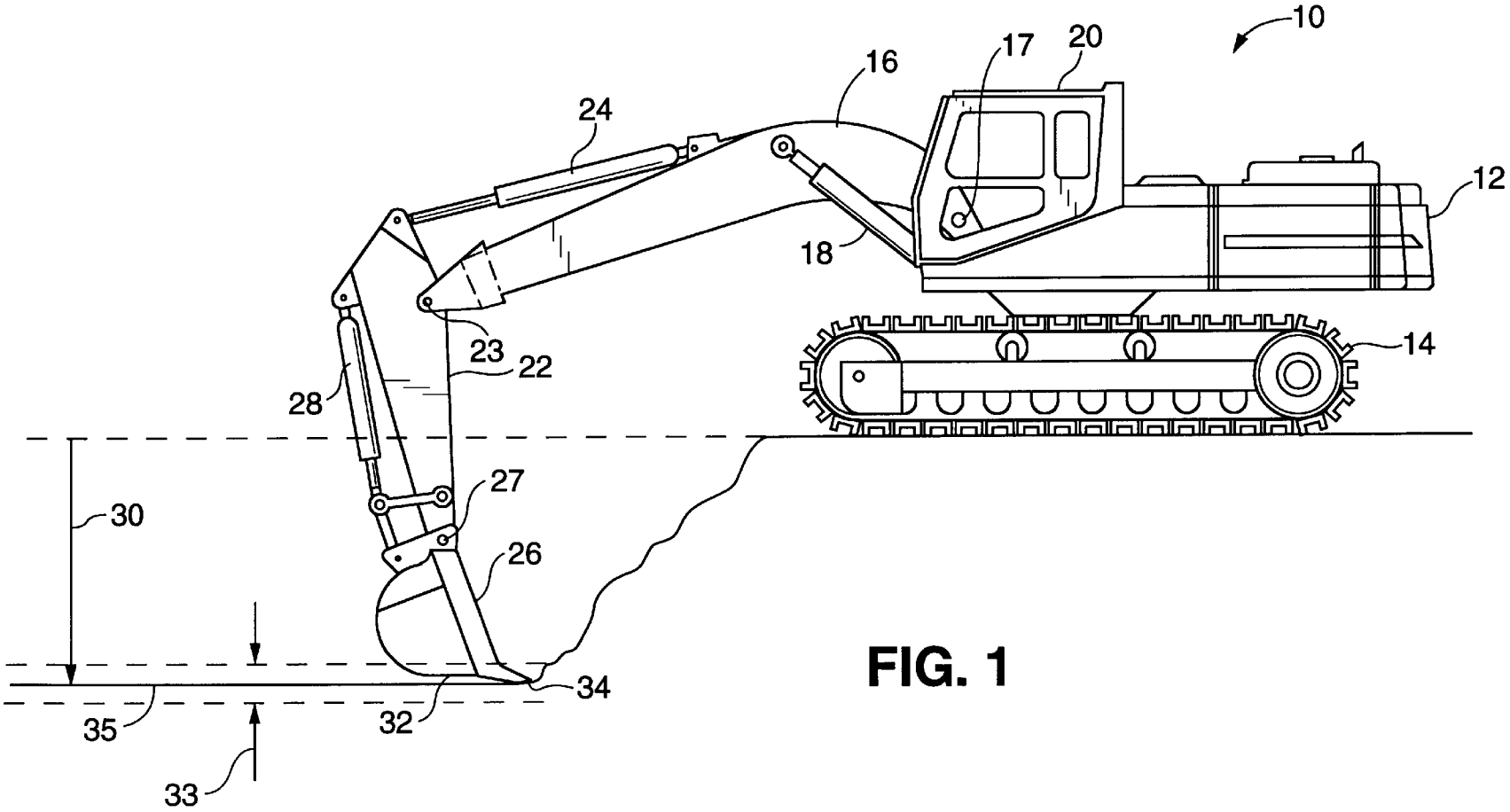
FIG. 1 is a side elevation view of an excavator grading an excavated surface to a desired depth in accordance with the present invention.

The present invention is implemented on an excavator. As shown in FIG. 1, an excavator 10 has a machine base 12 that is rotatably mounted on tracks 14. A boom 16 is pivotally mounted at pivot 17 on the machine base 12 and extends outward. A hydraulic cylinder 18, controlled by an operator sitting in a cab 20 or by a machine control system, moves the boom relative to the machine base during the excavation process. A stick 22 is pivotally mounted at pivot 23 to the outer end of the boom 16. Similarly, a hydraulic cylinder 24 moves the stick relative to the boom during excavation. A bucket 26 is pivotally mounted at pivot 27 to an outer end of the stick 22. A hydraulic cylinder 28 moves the bucket relative to the stick during excavation.

The excavator 10 is shown in FIG. 1 to be digging to a fixed depth 30 below the surface. The bucket 26 has a bottom surface 32 and has a cutting edge 34 at the leading edge of the bucket which digs into the earth during excavation. The automatic depth control feature of the present invention is engaged when the cutting edge 34 of the bucket 26 is within a working depth window 33 of the desired grade 35. In the preferred embodiment, that working depth window is 6 inches (0.5 feet) above and below the desired grade when operating in depth-control mode. If the cutting edge 34 of the bucket 26 is positioned outside the working depth window 33, either more than six inches below the desired grade 35 or more than six inches above the desired grade, then the automatic depth control feature will not engage. This permits the operator to control the excavator manually until the cutting edge of the bucket is within the working depth window, and then take a final cut under automatic control to obtain the desired finished surface.

Figure 2:
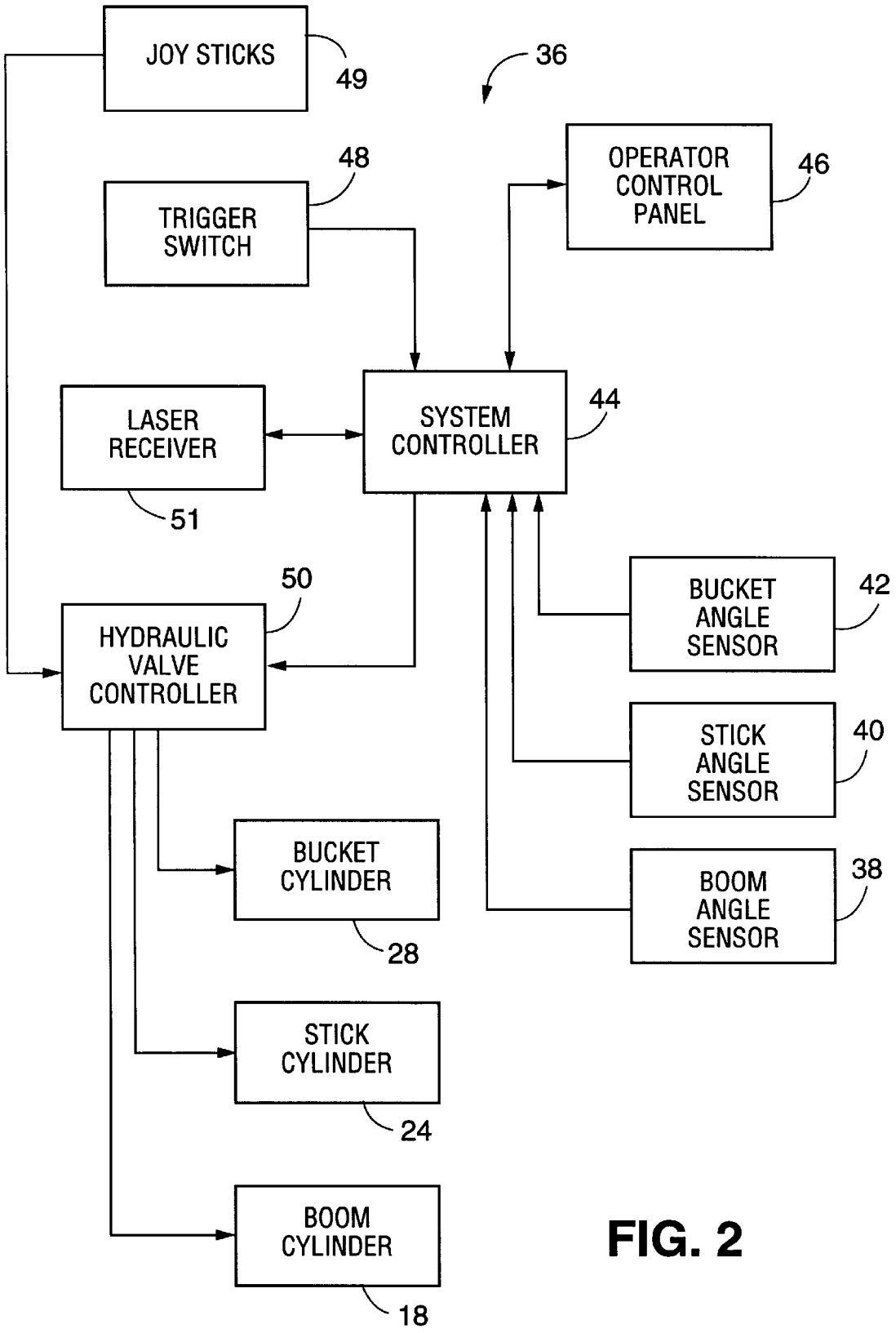
FIG. 2 is a block diagram of a machine control system which is used in conjunction with the present invention.

FIG. 2 is a block diagram of a machine control system 36 that is used in conjunction with the method of the present invention. The machine control system 36 includes three angle sensors 38, 40, and 42, that provide data to a system controller 44 about the angular positions of the boom 16, stick 22, and bucket 26, respectively. The sensors are mounted on the excavator near the pivots 17, 23, and 27 of the boom, stick, and bucket, respectively. The system controller 44 is a programmed processor that determines the actual position of the bucket during excavation by knowing the angles measured by the angle sensors and the geometries of the boom 16, stick 22, and bucket 26. The operation of the system controller 44 in that regard is well known in the art and is not further disclosed herein. The system controller 44 is coupled to an operator control panel 46 and a trigger switch 48, which will be discussed in more detail below. The system controller 44 sends control signals to a hydraulic valve controller 50, which controls the movement of the boom cylinder 18 and bucket cylinder 28. A laser receiver 51 is optionally included in the machine control system. The laser receiver 51 detects the elevation at which a reference laser beam strikes a mast mounted to the excavator, thus providing an elevation reference.

The block diagram of FIG. 2 also indicates a pair of joysticks 49 that provides manual control inputs to the hydraulic valve controller 50. The operator moves the joysticks to control the bucket, stick, and boom cylinders when operating under manual control. Under automatic control, in the preferred embodiment, the operator manually controls the stick cylinder 24 only, and the system controller 44 automatically controls the boom cylinder 18 and the bucket cylinder 28 to excavate to the desired slope or depth.

The operator control panel 46 provides the operator a means for inputting data into the system controller 44 to define the operational parameters of the machine control system 36. The control panel 46 also provides a display of information to the operator for monitoring the excavation process, whether controlled manually by the operator or automatically by the machine control system 36. A full description of the operation of the control panel and the various screens utilized thereby are contained in U.S. Pat. No. 5,854,988, filed on the same day as the present application, and entitled "Method for Controlling an Excavator," which is hereby incorporated by reference.

The control panel 46 has a flat panel display that is touch sensitive. The control panel displays various screens during the operation of the excavation, and the touch sensitive screen provides a means for the operator to input information to the system controller 44 by touching an appropriate area of the screen, typically defined by a labeled box. Basically, the system controller can operate in several modes, including depth-control mode, multiple-layer mode, slope-control mode, and laser mode. Each mode includes a set-up screen, which allows the operator to input data to define the desired depth or slope, and an indicate screen, which displays an icon of the bucket and its position with respect to the desired grade.

The operator selects the depth-control mode of operation and enters data defining a desired depth by entering the appropriate commands on the control panel 46. Once the desired depth value has been entered, the excavator is ready to excavate to create a graded surface having that depth. The operator manually positions the bucket 26 and adjusts the bucket angle by controlling the bucket cylinder 28, stick cylinder 24, and/or boom cylinder 18 through the hydraulic valve controller 50 using the joysticks 49. To begin automatic control, the operator presses the trigger switch 48, which is mounted on or near the cylinder control joysticks 49. Activating the trigger switch 48 enables the automatic depth control function, but automatic depth control is engaged only if the cutting edge 34 of the bucket 26 is within the working depth window 33 of the desired depth 35 (FIG. 1).

Figure 3A:
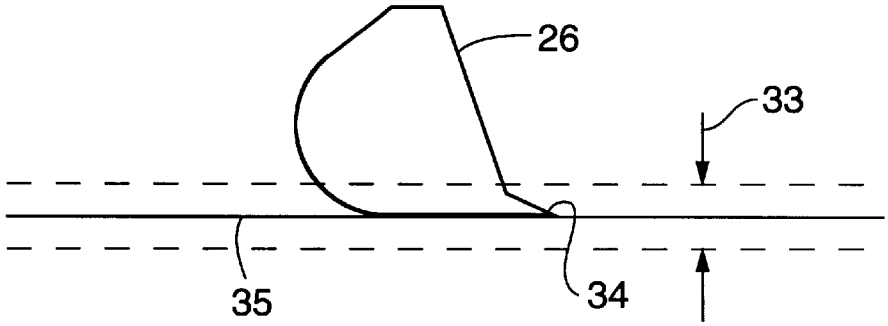
FIGS. 3A, 3B, and 3C, sometimes referred to herein collectively as FIG. 3, are diagrams indicating the position of an excavator bucket relative to a desired depth of the excavated surface.
Figure 3B:
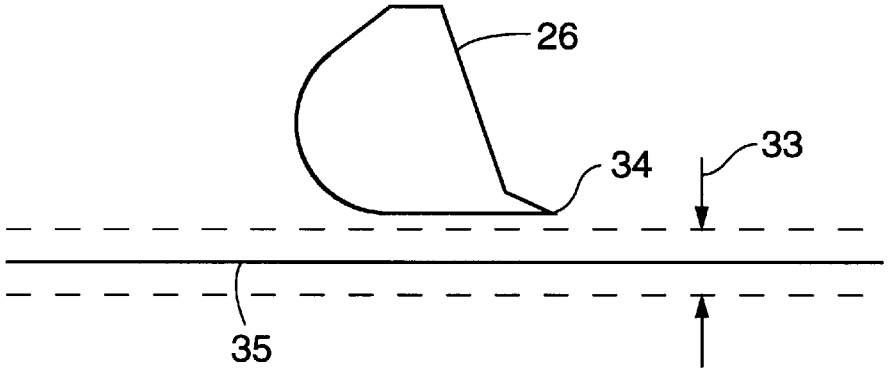
Figure 3C:
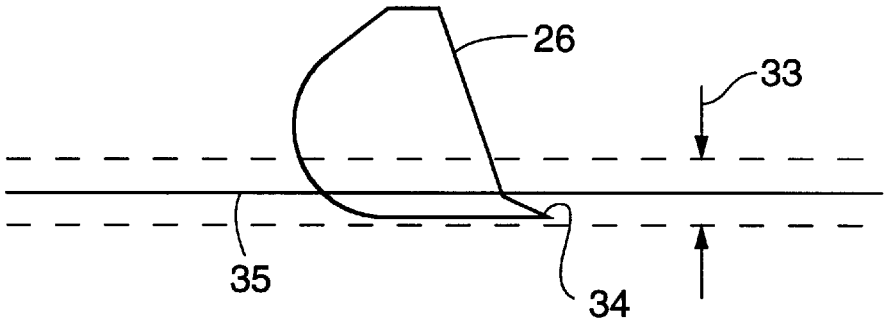

FIG. 3 shows the bucket 26 with respect to the desired grade 35 and the working depth window 33. FIG. 3A shows the bucket with its cutting edge 34 positioned at the desired grade 35 within the working depth window 33, which permits the automatic depth control function to engage and to control the movement of the bucket so that the cutting edge follows the desired grade during an excavation pass. FIG. 3B shows the bucket positioned outside the working depth window 33. The automatic depth control function will not engage because the bucket is too high. The operator will need to dig deeper until the working depth window is reached in order to engage the automatic depth control. FIG. 3C shows the bucket positioned within the working depth window, but below the desired grade 35. If the bucket is positioned within the window and the operator presses the trigger switch 48, the automatic depth control will move the bucket to the desired grade 35, in this case upward.

In depth control mode, there are two types of automatic control in accordance with the present invention, depending on the angular orientation of the bucket: depth and bucket angle, or depth only. If the bottom surface of the bucket is horizontal, or is inclined at an angle within a working angular window of horizontal, then the system controller 44 causes the bucket to maintain that same angular orientation throughout the digging pass under a first type of automatic control. In the first type of automatic depth control, both the depth and bucket angle are automatically controlled. The bucket translates at a fixed angular orientation through the excavation pass with the cutting edge 34 following the desired depth 35, and this is achieved by the system controller 44 controlling both the bucket cylinder 28 and the boom cylinder 18.

The second type of automatic depth control (depth only) is engaged if the bottom surface of the bucket is inclined at an angle outside of the working angular window, in which case the system controller 44 controls the boom cylinder 18 but not the bucket cylinder 28. In the second case, the angular orientation of the bucket changes as the stick 22 moves during the excavation pass. Both cases are engaged only if the cutting edge of the bucket is within the working depth window 33 when the operator presses the trigger switch 48 to enable automatic control.

The first type of automatic depth control (depth and bucket angle) is achieved by the system controller 44 controlling both the boom cylinder 18 and the bucket cylinder 28 during the excavation pass. The second type of automatic depth control (depth only) is achieved by automatically controlling only the boom cylinder 18. In both cases, the operator manually controls the stick cylinder 24 through a joystick 49, which gives the operator control over how fast the digging pass will progress. If the bucket 26 is sufficiently close to the desired depth 35 when the trigger switch is activated (within the working depth window 33), then the system controller 44 automatically constrains the movement of the bucket so that the cutting edge 34 of the bucket 26 grades to the desired depth. Under automatic control, the system controller 44 monitors the inputs from the angle sensors 38, 40, and 42 and instructs the valve controller 50 to extend or retract the boom cylinder 28 and optionally the bucket cylinder 28 to move the digging edge 34 of the bucket 26 along the desired depth 35.

When the digging pass is completed, the operator needs to dump the load in the bucket. The trigger switch 48 is released, taking the excavator out of automatic control, and the bucket is controlled manually by the operator to dump it. Thereafter, the operator can make additional digging passes, or reposition the excavator, as appropriate.

Figure 4:
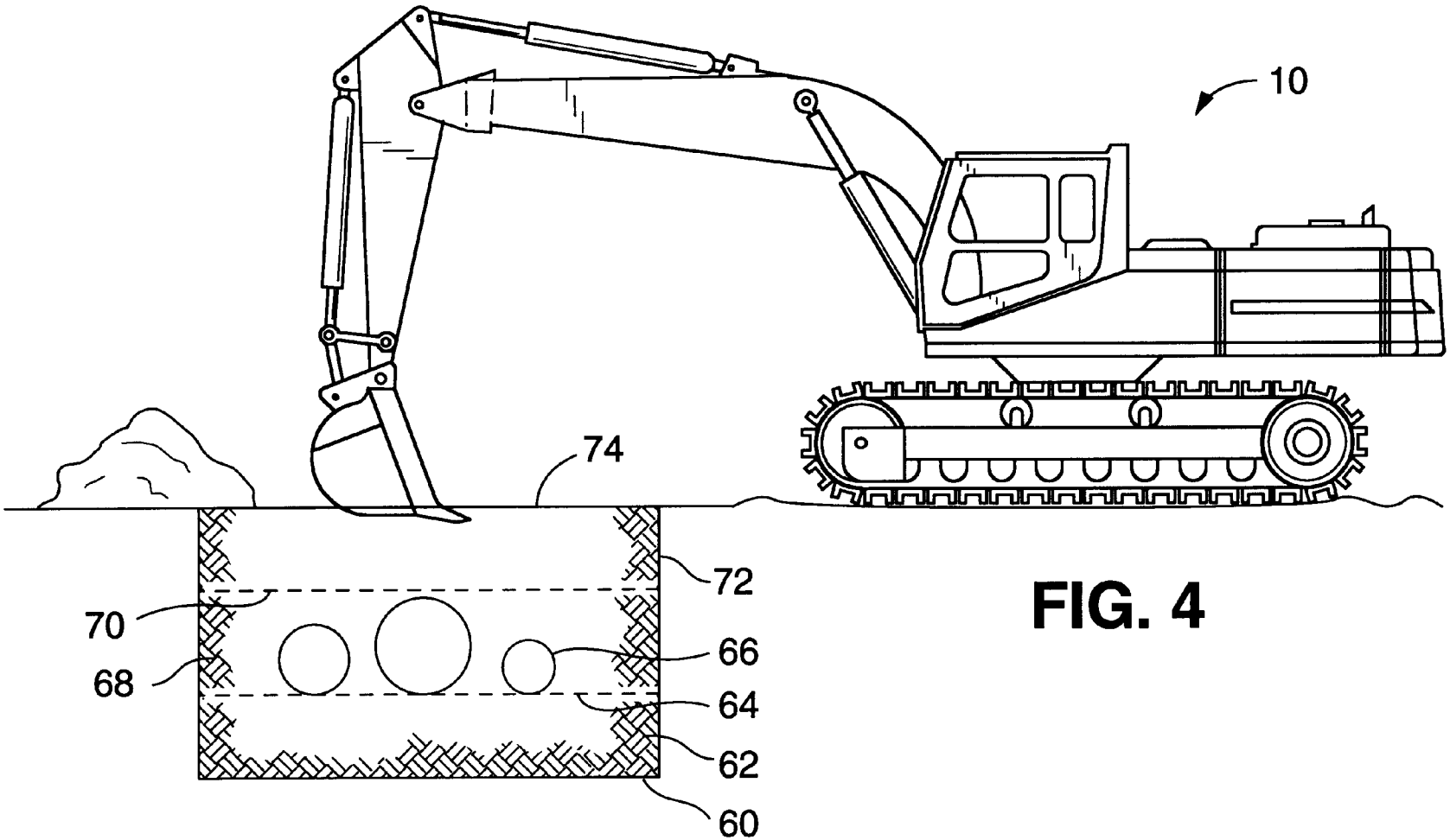
FIG. 4 is a side elevation view of an excavator grading a plurality of layers to desired depths in accordance with the present invention.

The automatic depth control feature of the present invention can be used to grade multiple layers of materials. As shown in FIG. 4, an excavation job may require digging a trench down to a certain depth 60, and then backfilling with bedding material 62 to another depth 64, then laying pipe 66 on the bedding material and covering the pipe with cover material 68 to another depth 70, and then backfilling with still more material 72 to yet another depth 74.

The operator inputs data through the control panel 46 to define the multiple depths. During the initial digging of the trench to the desired depth 60, the automatic depth control is engaged when the cutting edge of the bucket is within the working depth window at the bottom of the trench at depth 60. Then the bedding material 62 is dumped into the trench and leveled by the excavator using the automatic depth control set at the bedding depth 64. All the operator needs to do to engage the automatic depth control at depth 64 is to position the cutting edge of the bucket within 6 inches of that depth, and to then activate the trigger switch 48. After the pipe 66 is laid and the cover material 68 dumped on top, the excavator spreads and levels the cover material by automatic depth control to the depth 70. Finally, the layer of backfill material 72 is spread and automatically graded to the proper depth 74.

In the multiple layer mode, no reprogramming of the depth is required to switch between automatic grading of the different layers; the data is entered at the beginning of the job. The system controller 44 knows which depth to control to by the operator placing the bucket within one of the four working depth windows. Thus, the present invention enables the various depths and layer thicknesses to be defined once for the entire multiple layer excavation task, and for the automatic depth control to be engaged whenever the bucket is within the working depth window of one of the desired levels.

Figure 5:
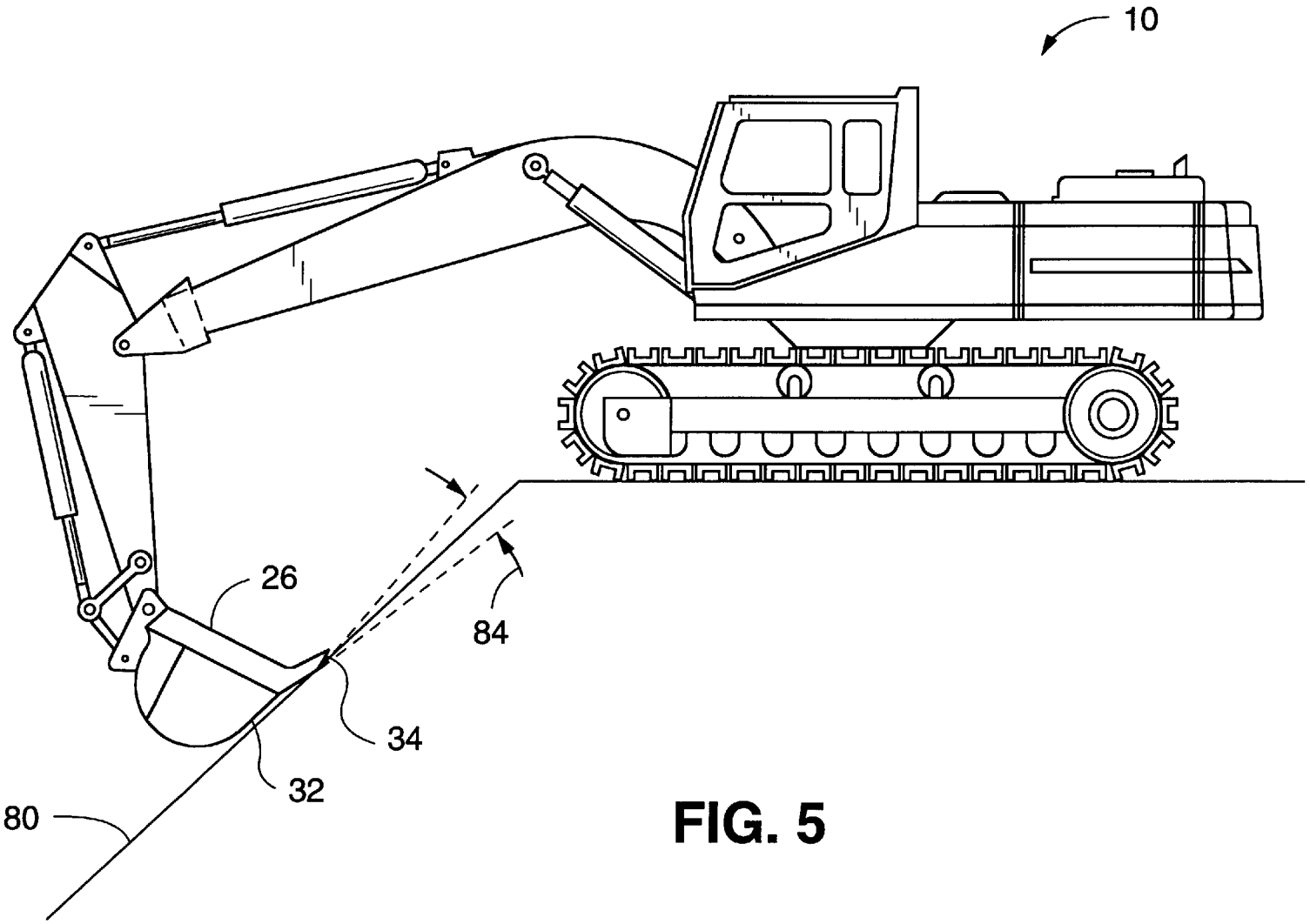
FIG. 5 is a side elevation view of an excavator grading an excavated surface to a desired slope in accordance with the present invention.

In FIG. 5, the excavator 10 is shown digging a grade to a desired slope 80. In slope-control mode, there are two aspects of automatic control. One aspect is automatically controlling the movement of the bucket 26 so that the cutting edge 34 of the bucket cuts at the desired angle of slope 80. This aspect of automatic slope control does not depend on positioning the bucket within a working window as does the automatic depth control. The second aspect of automatic control in slope-control mode is automatically controlling the angular orientation of the bucket. According to the present invention, the bucket angle is automatically controlled in slope-control mode if the bottom surface of the bucket is within a working angular window of the desired slope.

Automatic bucket angle control, according to the present invention, is engaged when the slope of the bottom surface 32 of the bucket 26 is within a working angular window 84 of the desired slope 80. In the preferred embodiment, that working angular window is 10% slope (5.7 degrees) above or below the desired slope. If the bucket 26 is positioned outside the working angular window 84, so that the slope of its bottom surface 32 is more than a 10% slope different from the desired slope, then the automatic bucket angle control feature will not engage. If the bucket is positioned parallel to the desired slope, it is within the working angular window and the automatic bucket angle control can be engaged by the operator activating the trigger switch during a digging pass.

Figure 6A:
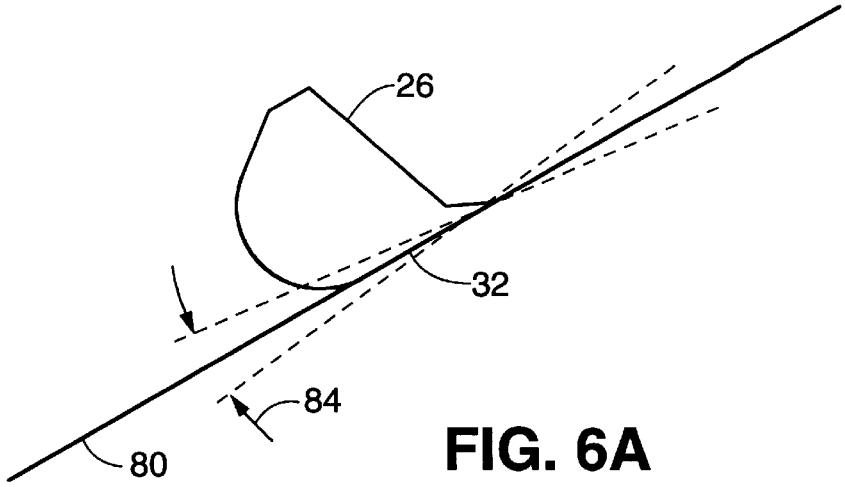
FIGS. 6A, 6B, and 6C, sometimes referred to herein collectively as FIG. 6, are diagrams indicating the angular orientation of an excavator bucket relative to a desired slope of the excavated surface.
Figure 6B:
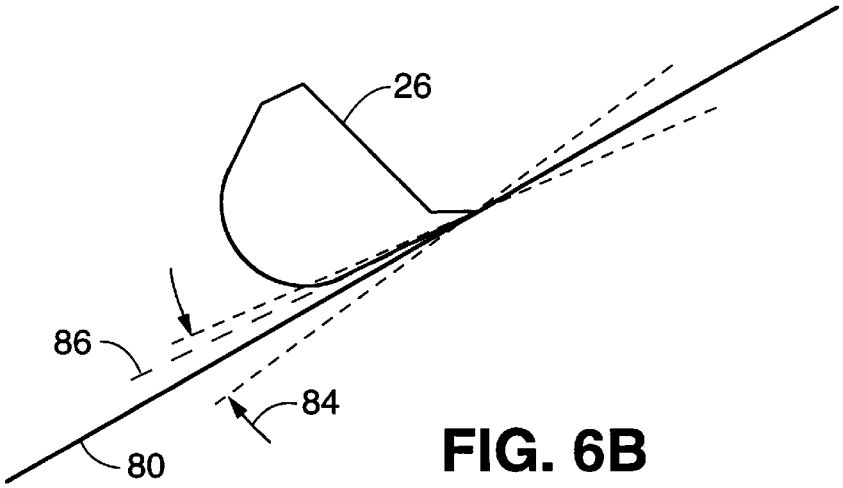
Figure 6C:
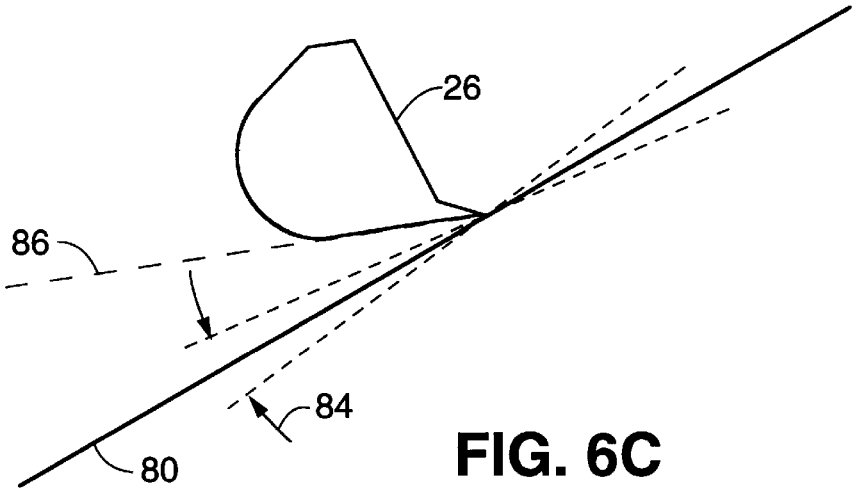

FIG. 6 shows the bucket 26 in several positions relative to the desired slope 80. In FIG. 6A, the bottom surface 32 of the bucket is parallel to the desired slope 80, just like in FIG. 5. The automatic bucket angle control of the present invention can be engaged because the bucket is within the working angular window 84. In FIG. 6B, the bottom surface 32 of the bucket is inclined relative to the desired slope, but its slope 86 is still within the working angular window 84, which permits the automatic bucket angle control to be engaged. In FIG. 6C, however, the bucket is inclined so much that the slope 86 of the bottom surface is not within the working angular window, in which case it is not possible to engage the automatic bucket angle control.

To operate in slope-control mode, the operator defines the desired slope 80 by entering data into the control panel 46. Once the desired slope data has been entered, the excavator is ready to excavate to that slope. The operator manually positions the bucket at a desired depth of cut and adjusts the bucket angle by controlling the bucket cylinder 28, stick cylinder 24, and/or boom cylinder 18 through the hydraulic valve controller 50 using the joysticks 49. To begin automatic control, the operator presses the trigger switch 48, which is mounted on or near the cylinder control joysticks 49. Activating the trigger switch 48 causes the system controller to begin automatic control to constrain the cutting edge 34 of the bucket 26 to move parallel to the desired slope 80 (FIG. 5). If the slope of the bottom surface of the bucket is within the working angular window 84 relative to the desired slope, then the machine control system 36 automatically controls the boom and bucket cylinders to move the bucket along the desired slope and to maintain the current bucket angle. If the bucket angle is not within the working angular window 84, then the machine control system controls only the boom cylinder to move the cutting edge of the bucket along the desired slope.

Figure 7:
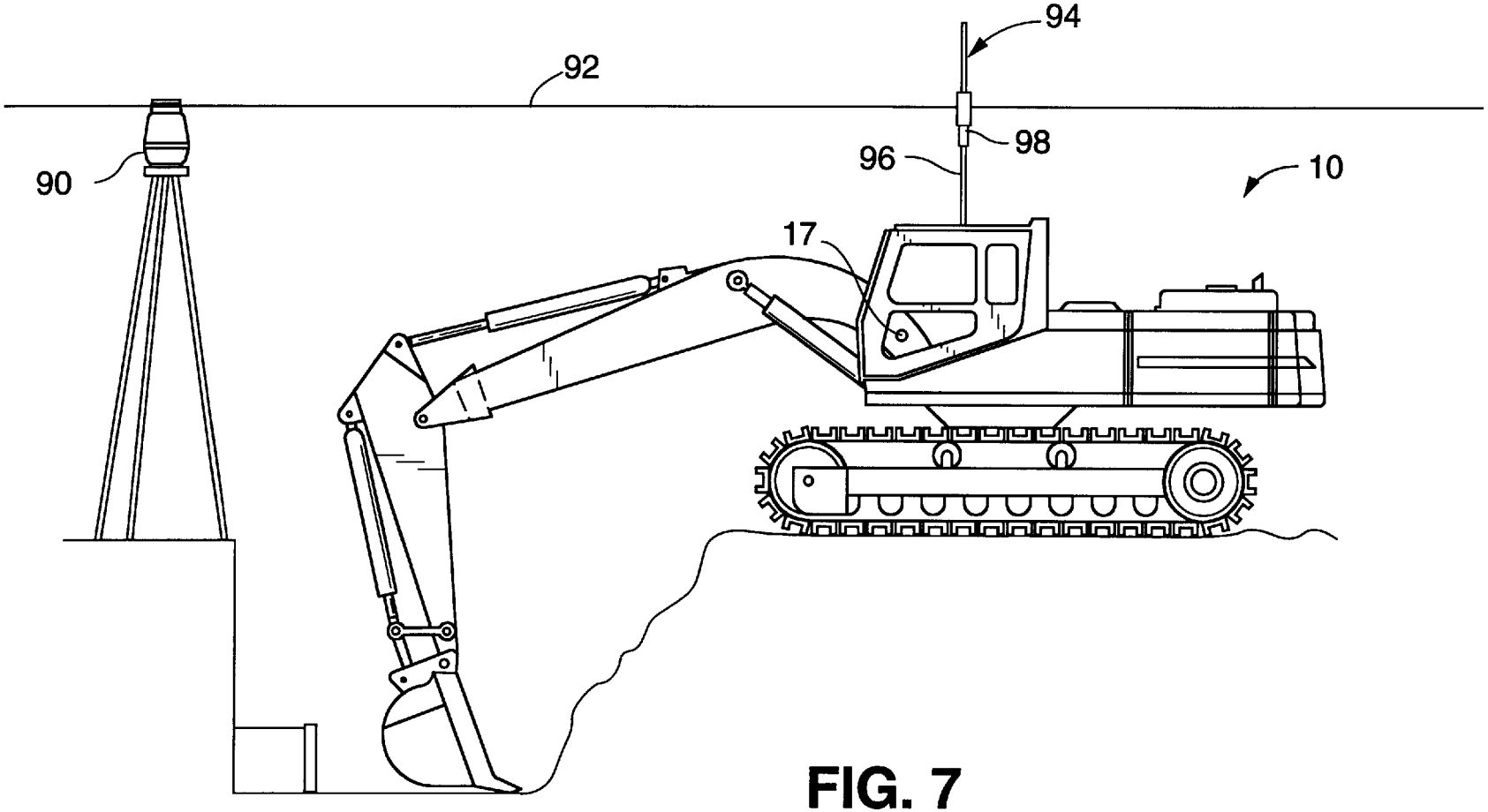
FIG. 7 is a side elevation view of an excavator operating in laser mode in accordance with the present invention.

In addition to the depth-control and slope-control modes of operation, the machine control system 36 can operate in a laser mode using a laser beam as an elevation reference. As shown in FIG. 7, the laser mode requires two additional pieces of equipment. One is a laser transmitter 90 that generates a laser reference beam 92, typically a rotating or fan-sweeping beam. The laser reference beam 92 is preferably set at the same slope as the bottom of the excavated surface, either horizontal or at an angle. The second additional piece of equipment is a laser receiver 94 that is mounted on the excavator 10. The laser receiver has a mast 96 and a travelling sensor 98 that moves up or down the mast until it senses the laser reference beam 92. The laser receiver feeds data indicating the elevation of the laser reference beam to the system controller 44, which uses that data for its depth reference.

In the laser mode, the operator inputs a desired depth of the excavated surface relative to the laser reference beam 178, and also inputs a desired slope. If the slope is zero, then the defined cut is horizontal at the desired depth. If the slope is not zero, then the cut is defined by the line that runs at the desired slope through a point determined by the desired depth at a point in vertical alignment with the pivot point 17 of the boom. After the parameters have been input, the operation in laser mode is similar to that in depth mode. The depth of the bucket is automatically controlled if the bucket is within the working depth window of the desired depth, and the bucket angle is automatically controlled if the bucket slope is within the working angular window of the desired slope.

From the above description, it will be apparent that the invention disclosed herein provides a novel and advantageous method for controlling the depth and angle of an excavator bucket to excavate a surface to a desired contour. The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A method for controlling an excavator to excavate a surface to a desired contour, wherein the excavator has an excavator bucket, and wherein the method comprises the steps of:

providing a machine control system coupled to the excavator, wherein the machine control system includes means for determining the position of the excavator bucket and further includes means for automatically controlling movement of the excavator bucket;

inputting data to the machine control system to define a desired contour of the excavated surface;

manually controlling movement of the excavator bucket;

manually enabling automatic control; and in response to the step of manually enabling automatic control, switching from manual to automatic control of the excavator bucket only when the position of the excavator bucket is within a predetermined measure of the desired contour and continuing in manual control if the position of the excavator bucket is not within the predetermined measure of the desired contour.

2. A method as recited in claim 1 wherein the desired contour is a depth of the excavated surface, and wherein the step of inputting data defines a desired depth of the excavated surface.

3. A method as recited in claim 2 wherein the step of automatically controlling is performed when a cutting edge of the excavator bucket is within a predetermined distance of the desired depth of the excavated surface.

4. A method as recited in claim 3 wherein the predetermined distance is a distance above or below the desired depth of the excavated surface.

5. A method as recited in claim 4 wherein the predetermined distance is about six inches above or below the desired depth of the excavated surface.

6. A method as recited in claim 2 applied to excavating a plurality of surfaces at different depths, wherein the step of inputting data defines a desired depth of each of the plurality of surfaces.

7. A method as recited in claim 6 wherein the step of automatically controlling is performed when the cutting edge of the excavator bucket is within a predetermined distance of a desired depth of one of the plurality of surfaces.

8. A method as recited in claim 1 wherein the desired contour is a slope of the excavated surface, and wherein the step of inputting data defines a desired slope of the excavated surface.

9. A method as recited in claim 8 wherein the step of automatically controlling is performed when the slope of a bottom surface of the excavator bucket is within a predetermined angle of the desired slope of the excavated surface.

10. A method as recited in claim 1 wherein the step of enabling automatic control includes activating a trigger switch.

11. A method for controlling an excavator and movement of its bucket to excavate a surface to a desired depth, said method comprising the steps of:

providing a machine control system coupled to the excavator, wherein the machine control system includes means for determining the position of the excavator bucket and further includes means for automatically controlling movement of the excavator bucket;

inputting data to the machine control system to define a desired depth of the excavated surface;

manually controlling movement of the excavator bucket;

manually enabling automatic control; and in response to the step of manually enabling automatic control, switching from manual to automatic control of the excavator bucket to maintain a desired digging depth only when automatic control is enabled and the excavator bucket is within a predetermined distance of the desired depth of the excavated surface.

12. A method as recited in claim 11 further comprising the step of automatically controlling movement of the excavator bucket to maintain a constant angular orientation only when the slope of a bottom surface of the excavator bucket is within a predetermined angle of horizontal.

13. A method for controlling an excavator to excavate a surface to a desired slope, wherein the excavator has an excavator bucket, and wherein the method comprises the steps of:

providing a machine control system coupled to the excavator, wherein the machine control system includes means for determining the position and angular orientation of the excavator bucket and further includes means for automatically controlling movement of the excavator bucket;

inputting data to the machine control system to define a desired slope of the excavated surface;

manually controlling movement of the excavator bucket;

manually enabling automatic control;

automatically controlling movement of the excavator bucket along the desired slope; and in response to the step of manually enabling automatic control, switching from manual to automatic control of the excavator bucket to maintain a constant angular orientation only when automatic control is enabled and the slope of a bottom surface of the excavator bucket is within a predetermined angle of the desired slope of the excavated surface.

14. A method for controlling an excavator to excavate a plurality of surfaces at different depths, wherein the excavator has an excavator bucket, and wherein the method comprises the steps of:

providing a machine control system coupled to the excavator, wherein the machine control system includes means for determining the position of the excavator bucket and further includes means for automatically controlling movement of the excavator bucket;

inputting data to the machine control system to define a desired depth of each of the plurality of excavated surfaces;

manually controlling movement of the excavator bucket;

manually enabling automatic control; and in response to the step of manually enabling automatic control, switching from manual to automatic control of the excavator bucket only when automatic control is enabled and the position of the excavator bucket is within a predetermined distance of a desired depth of one of the plurality of surfaces and otherwise manually controlling movement of the excavator bucket.

* * * * *